US007100706B2

(12) United States Patent
Meixner et al.

(10) Patent No.: US 7,100,706 B2
(45) Date of Patent: Sep. 5, 2006

(54) HAND TOOL MACHINE COMPRISING A VIBRATION-DAMPENED HANDLE

(75) Inventors: Gerhard Meixner, Filderstadt (DE); Pierre Jeannin, Morges (CH); Patrick Maillard, Lausanne (CH)

(73) Assignee: Robert Bosch GmbH, Stuttgart (DE)

( * ) Notice: Subject to any disclaimer, the term of this patent is extended or adjusted under 35 U.S.C. 154(b) by 126 days.

(21) Appl. No.: 10/297,373

(22) PCT Filed: Feb. 20, 2002

(86) PCT No.: PCT/DE02/00622

§ 371 (c)(1),
(2), (4) Date: Dec. 5, 2002

(87) PCT Pub. No.: WO02/083369

PCT Pub. Date: Oct. 24, 2002

(65) Prior Publication Data

US 2003/0132016 A1 Jul. 17, 2003

(30) Foreign Application Priority Data

Apr. 11, 2001 (DE) ..... 101 18 137
Aug. 3, 2001 (DE) ..... 101 38 123

(51) Int. Cl.
*B25D 17/04* (2006.01)

(52) U.S. Cl. ..... 173/162.2; 173/162.1; 173/170

(58) Field of Classification Search ..... 173/162.1, 173/162.2, 170, 211; 81/177.1, 177.7, 177.8; 16/408; 267/192, 193, 195
See application file for complete search history.

(56) References Cited

U.S. PATENT DOCUMENTS

| | | | | | |
|---|---|---|---|---|---|
| 3,845,827 | A | * | 11/1974 | Gotthilf | 173/162.1 |
| 4,478,293 | A | * | 10/1984 | Weilenmann et al. | 173/162.2 |
| 4,749,049 | A | * | 6/1988 | Greppmair | 173/162.2 |
| 5,025,870 | A | | 6/1991 | Gantner | |
| 5,692,574 | A | * | 12/1997 | Terada | 173/162.2 |
| 5,697,456 | A | | 12/1997 | Radle et al. | |
| 6,076,616 | A | * | 6/2000 | Kramp et al. | 173/162.2 |
| 6,123,158 | A | * | 9/2000 | Steffen | 173/217 |

FOREIGN PATENT DOCUMENTS

| | | |
|---|---|---|
| DE | 195 03 526 A1 | 8/1996 |
| EP | 0 206 981 A | 12/1986 |
| EP | 0 849 492 A | 6/1998 |
| WO | 98/21014 | 5/1998 |

* cited by examiner

*Primary Examiner*—Louis K. Hugnh
*Assistant Examiner*—Thanh Truong
(74) *Attorney, Agent, or Firm*—Michael J. Striker

(57) ABSTRACT

A coupling between the handle (2) and the machine housing (1) of a hand power tool having the greatest possible vibration damping is produced by the fact that the handle (2) is coupled with the machine housing (1) via two or more parallel levers (4, 5) situated nearly perpendicular to the longitudinal axis (3) of the hand power tool, whereby the levers (4, 5) are hinge-mounted on the machine housing (1) on the one hand and on the handle (2) on the other hand.

6 Claims, 3 Drawing Sheets

HAND TOOL MACHINE COMPRISING A VIBRATION-DAMPENED HANDLE

BACKGROUND OF THE INVENTION

Figure 1:
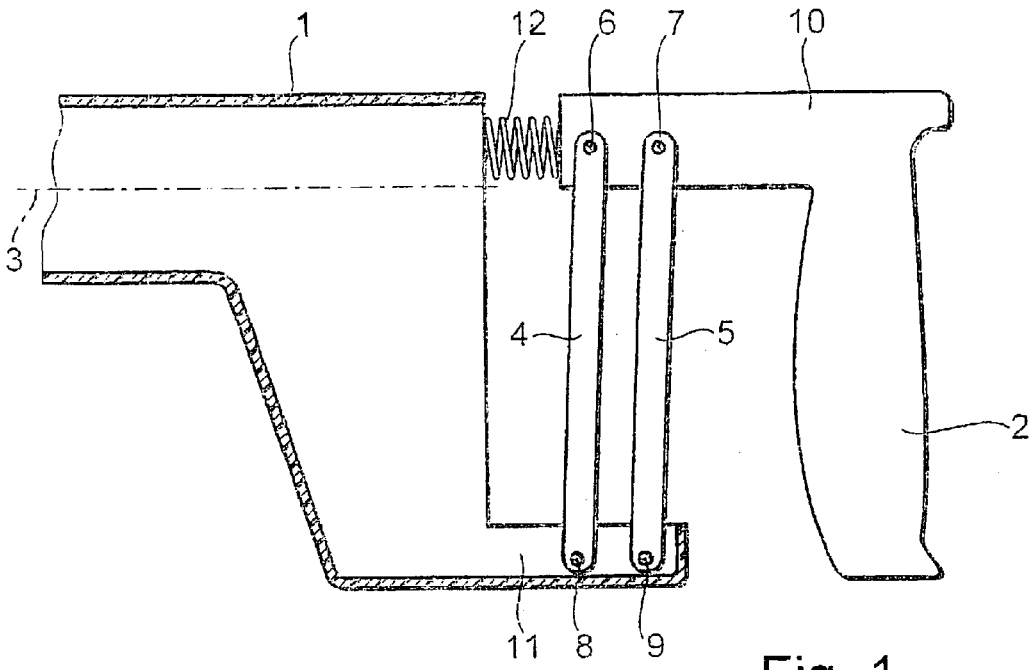

The present invention concerns a hand power tool with vibration-damped handle that is coupled with the machine housing using damping means.

In the case of hand power tools having a striking drive in particular, e.g., drilling hammers, chipping hammers, and the like, extremely strong vibrations are produced in the machine that are transferred to the handle of the machine and are not only uncomfortable for the operator, but they can be harmful as well. Measures are made known in DE 195 03 526 A1 or U.S. Pat. No. 5,697,456, for example, for damping the handle of a hand power tool against vibrations. These measures are based on the fact, for example, that the handle is joined at one end with the machine housing via a damping spring or a spring system, and that the handle is joined on the opposite end with the machine housing by means of a pivot joint. It is also proposed in DE 195 03 526 A1 that the handle is joined at both ends with the machine housing via a vibration-damping material, e.g., thermoplastic elastomer plastic. It has also been common so far to join the handle with the machine housing at two points. Even when one or two coupling points are equipped with damping means, a relatively high amount of vibrations is still transferred from the machine housing to the handle.

The use of one or more active, electrically controllable damping elements to dampen vibrations between the handle and the machine housing that counteract the vibrations of the machine housing is made known in WO 98/21014.

The invention is based on the object of providing a hand power tool having a handle of the type originally described that is joined to the machine housing of the hand power tool in a fashion that provides the greatest possible vibration damping.

ADVANTAGES OF THE INVENTION

The stated object is obtained 1 by the fact that the handle is coupled with the machine housing via two or more parallel levers situated nearly perpendicular to the longitudinal axis of the hand power tool, whereby the levers are hinge-mounted on the machine housing on the one hand, and on the other hand, on the handle. With such a "parallel rocker arm", the handle achieves very high stability and is well protected against vibrations in the machine housing, because it does not have any direct connection points with the machine housing.

With such a lever, it is advantageous that the coupling point on the handle is as far away as possible from the coupling point on the machine housing. This ensures that the relative motion between the handle and the machine housing has nearly only one component in the direction of the longitudinal axis of the hand power tool. It is advantageous that, with all levers, the distances between each of their two coupling points are nearly the same. This prevents undesired motion effects of the handle.

All of the levers can be accommodated in the machine housing, or one or more levers can be placed in a shoulder of the handle extending substantially perpendicular to the longitudinal axis of the hand power tool. The parallel rocker arm can therefore be integrated in the hand power tool in space-saving fashion.

The vibration damping for the handle can be further increased by installing spring elements—preferably leaf springs—at one or more points between the handle and the machine housing. A further improvement of the vibration damping can be obtained by placing—rather than purely passive spring elements—one or more active damping elements between the handle and the machine housing that are controllable in such a fashion that they counteract vibrations in the machine housing.

The levers have a particularly vibration damping effect when they are designed as leaf springs. The leaf springs are advantageously preloaded against a force exerted on the handle in the direction of the machine housing.

It is advantageous to limit the relative motion of the handle in relation to the machine housing by means of one or more stops.

BRIEF OF THE DRAWINGS

The invention is described in greater detail with reference to a plurality of exemplary embodiments shown in the drawings.

Figure 2:
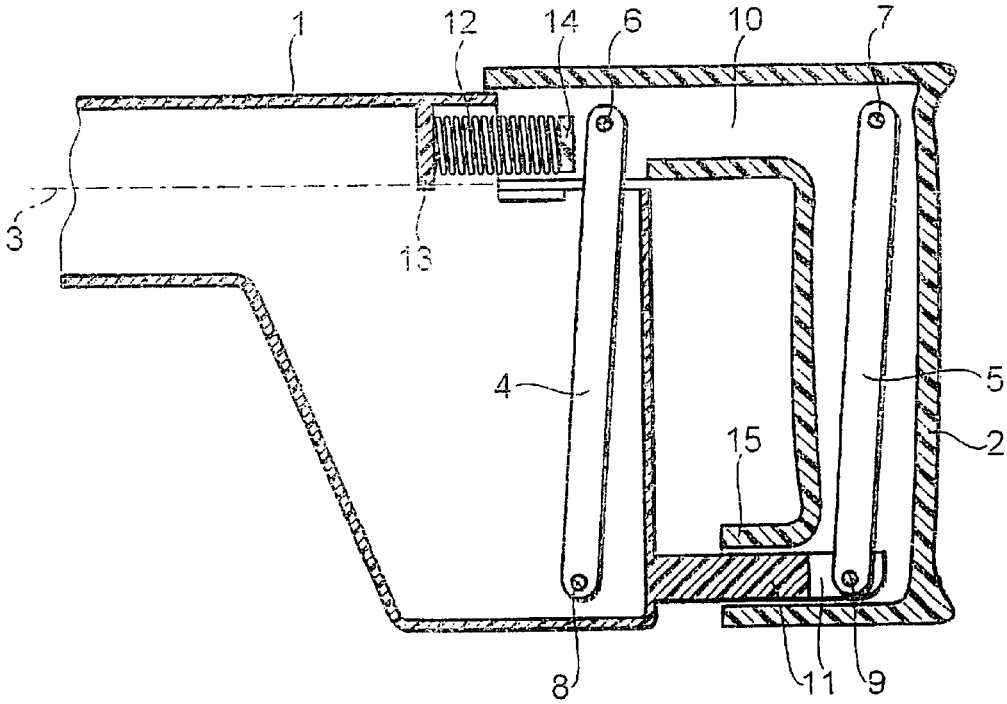
Figure 3:
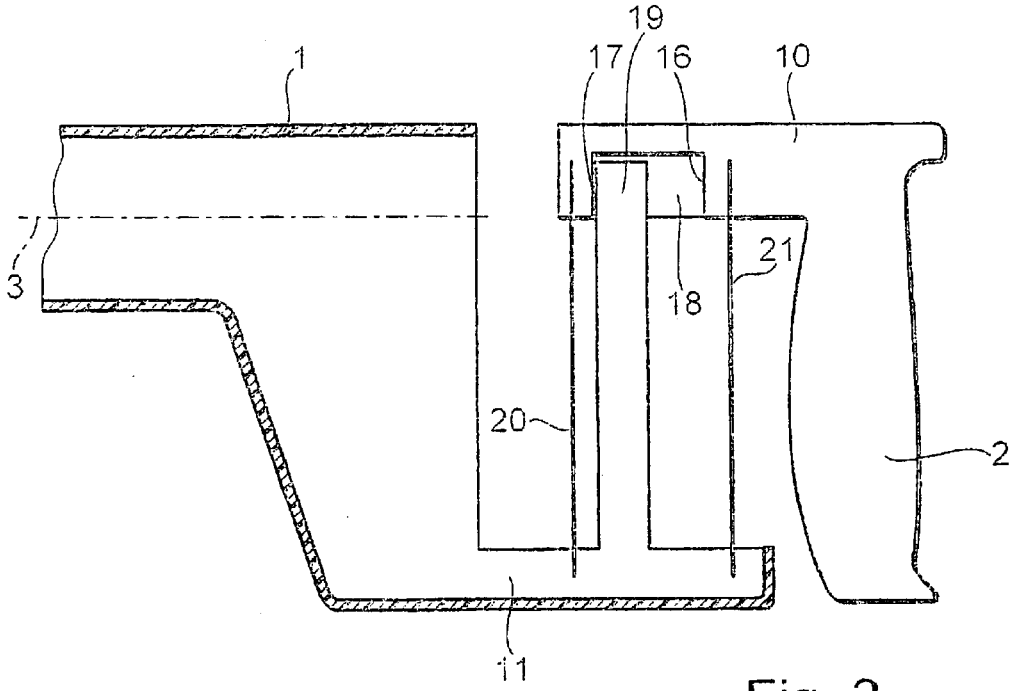
Figure 4:
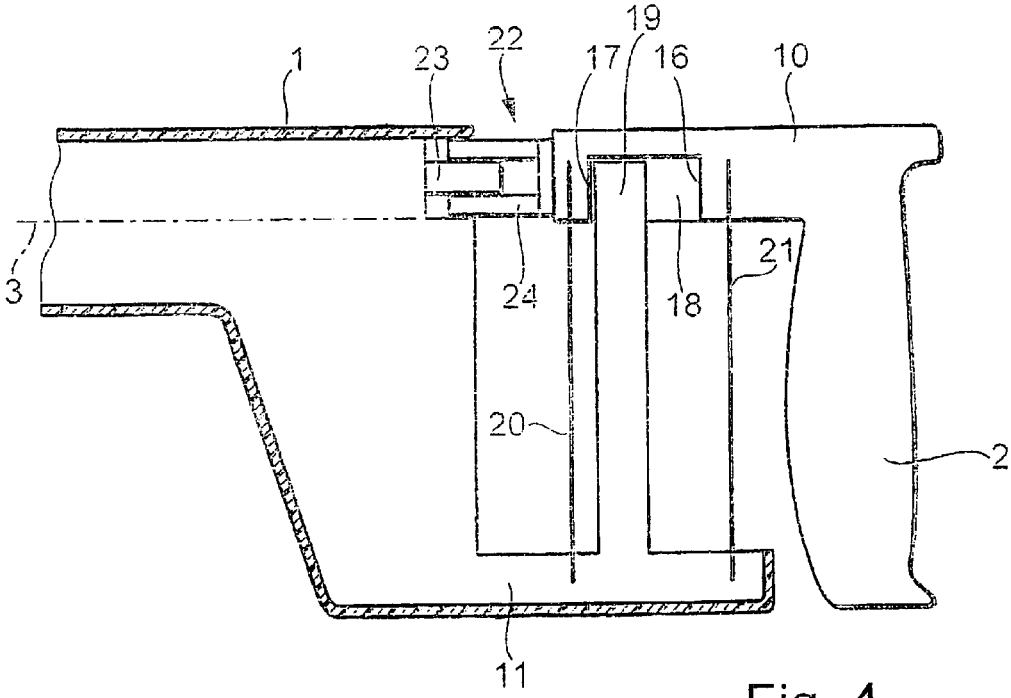
Figure 5:
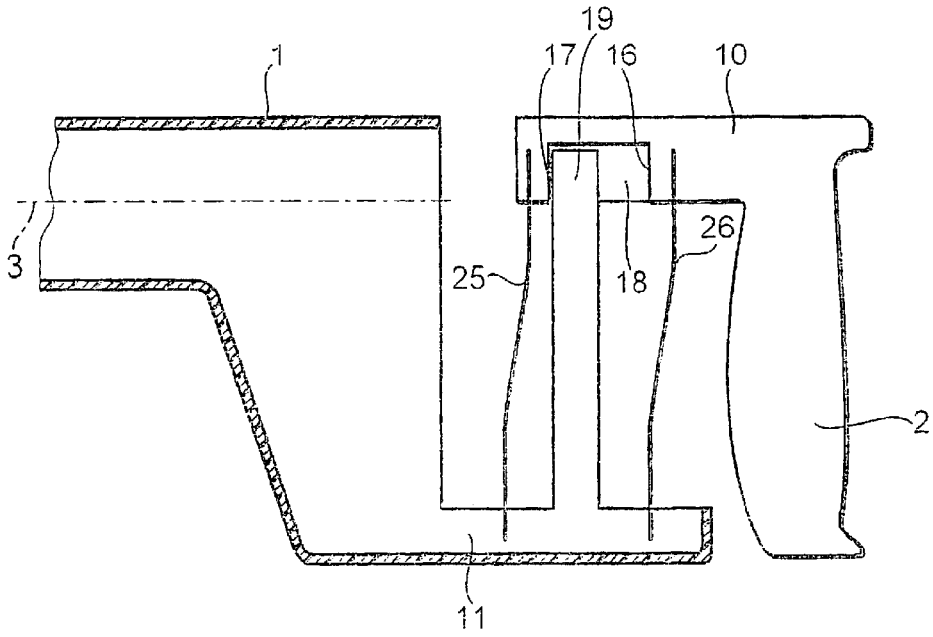

FIG. 1 shows a schematic representation of a handle supported on the machine housing by means of a parallel rocker arm, FIG. 2 shows a practical embodiment of the handle supported on the machine housing by means of a parallel rocker arm, FIG. 3 shows a hand power tool, in the case of which the pedal rocker arm is composed of leaf springs, and FIG. 4 shows a hand power tool having a parallel rocker arm and a damping element inserted between handle and machine housing, and FIG. 5 shows a hand power tool having a parallel rocker arm composed of preloaded leaf springs.

DETAILED DESCRIPTION OF THE PREFERRED EMBODIMENTS

A hand power tool, e.g., a drilling hammer or a chipping hammer or the like, is shown in FIG. 1. The hand power tool is composed of a machine housing 1 in which the machine drive is located, and a handle 2 coupled with the machine housing 1.

The handle 2 is coupled with the machine housing 1 via a parallel rocker arm. This parallel rocker arm is composed of two levers 4 and 5 situated parallel with one another and extending nearly perpendicular to the longitudinal axis 3 of the machine. Instead of the two levers 4 and 5 shown in the drawing, more than just two parallel levers can also be used. The levers 4 and 5 are hinge-mounted on the handle 2 on the one hand and on the machine housing 1 on the other hand in such a fashion that the handle 2 can perform a relative motion in relation to the machine housing 1 nearly exclusively in the direction of the longitudinal axis 3.

So that only one absolutely minimal portion of the tilting motion can occur between the handle 2 and the machine housing 1, the coupling point 6 or 7 on the handle 2—in the case of each lever 4 or 5—should be located as far as possible from the coupling point 8 or 9 on the machine housing 1. In order to fulfill this prerequisite as well as possible, the coupling points 6, 7 for both levers 4, 5 are located on the upper end—preferably on a shoulder 10 extending parallel to the longitudinal axis 3—of the handle 2. The two other coupling points 8 and 9 of the levers 4 and 5 are located on a carrier 11 located at the lower end of the machine housing 1. The coupling points 6, 7, 8, 9 of the individual levers 4, 5 are situated in such a fashion that—in the case of each lever 4, 5—the two coupling points 6, 8 and 7, 9 have the same distances between each other. If the distances are different, undesired motion effects can be produced at the handle—components of motion that deviate from a motion of the handle in the direction of the machine's longitudinal axis.

Damping means 12, preferably one or more compression springs, are inserted between the top end, the horizontally-extending shoulder 10, the handle 2, and the machine housing 1.

Due to the coupling between the handle 2 and the machine housing 1 designed as a parallel rocker arm, no direct connecting points are produced between the two, so that vibrations in the machine housing 1 are greatly damped when they are transferred to the handle 2.

While FIG. 1 shows a highly schematic representation of the coupling of the handle 2 to the machine housing 1 by means of a parallel rocker arm in order to illustrate the mode of operation, FIG. 2 shows an exemplary embodiment of the same coupling of a handle 2 to a maching housing 1 of a hand power tool that is more closely oriented to a practical application. All parts previously described in conjunction with FIG. 2 and performing the same function are labelled in FIG. 2 with the same reference numerals as in FIG. 1.

FIG. 2 shows that one stop 13 is located on the machine housing 1 and one stop 14 is located on the handle 2 for the compression spring 12 used as damping means between the handle 2 and the machine housing 1.

A very space-saving accommodation of the parallel rocker arm can take place by accommodating at least one of the levers 4, 5 in the shoulder of the handle 2 extending perpendicular to the longitudinal axis 13 of the hand power tool. For this purpose, the carrier 11 for the coupling point 9 of the lever 5 located on the machine housing 1 extends up to the shoulder of the handle 2 extending perpendicular to the longitudinal axis 3. The lower end of this shoulder of the handle 2 extending perpendicular to the longitudinal axis 3 can be equipped with a connection piece 15 enclosing the carrier 11. This connection piece 15 only forms an edge between the carrier 11 and the handle 2; it does not perform the function of a mechanical guide for the handle 2.

The further apart the levers 4, 5 of the parallel rocker arm are located from each other, the greater the stability of the handle. In this regard, the exemplary embodiment in FIG. 2—in the case of which the one lever 4 is located in the machine housing 1 and the other lever 5 is located relatively far away from lever 4 in the handle 2—results in a high level of stability of the handle 2. The width (in the direction perpendicular to the plane of the drawing) of the levers 4, 5 has a stability-enhancing effect as well.

Both levers 4, 5 of the parallel rocker arm can also be integrated in the machine housing 1 as well, however.

The described parallel rocker arm composed of the levers 4, 5 can be located on only one side of the handle 2, as shown in FIGS. 1 and 2; parallel rocker arms can also be provided on both sides—in the direction transverse to the longitudinal axis 3 of the machine—of the handle 2.

In the case of the exemplary embodiment shown in FIG. 3, the relative motions of the handle 2 in relation to the machine housing 1 are limited by an upper stop 16 and a lower stop 17. The two stops 16 and 17 are integrally molded on the shoulder 10 of the handle 2 extending in a horizontal direction. These two stops 16 and 17 can be inner walls of a recess in the shoulder 10 of the handle 2 extending in a horizontal direction, for example. An arm 19 permanently joined with the machine housing 1 extends into this recess 18. The movement of the handle 2 away from the machine housing 1 is limited by the fact that the arm 19 meets the lower stop 17. The movement of the handle 2 toward the machine housing 1 is limited by the fact that the arm 19 meets the upper stop 16. The distance between the two stops 16 and 17 therefore determines the amount of play there is in the motion of the handle 2. In contrast to the exemplary embodiment shown, the two stops 16 and 17 can also be located on the machine housing 1, and the arm 19 can be located on the handle 2. It is also possible for only one upper or lower stop to be provided on the machine housing 1 and/or on the handle 2.

In the case of the exemplary embodiments shown in FIGS. 1 and 2, the levers 4 and 5 forming the parallel rocker arm are rigid in design. In the exemplary embodiments shown in FIGS. 3 through 5, the levers 20 and 21 are designed as leaf springs. The two leaf springs 20 and 21 are anchored in the shoulder 10 of the handle 2 extending in a horizontal direction, on the one hand and, on the other, they are anchored in the housing 1, e.g., in the carrier 11. The leaf springs 20 and 21 are oriented with their broadsides transverse to the direction of motion of the handle 2, so that they are flexible in the direction of the longitudinal axis 3 of the hand power tool, and they are stiff in the direction transverse thereto. By means of the resilient action of the levers 20, 21 of the parallel rocker arm, vibrations travelling from the machine housing 1 in the direction toward the handle 2 can be intercepted to a great extent.

Due to the resilient action of the levers 20 and 21 designed as leaf springs, the spring element 12 inserted between the housing 1 and the handle 2 can possibly be eliminated, as shown in FIG. 3.

A spring element can also be used additionally to take up vibrations between the machine housing 1 and the handle 2, or—as shown in FIG. 4—it can be replaced by an active damping element 22 that is electrically controllable, for example, in such a fashion that it counteracts vibrations in the machine housing 1. Active damping elements that are used with hand power tools for vibration damping of the handle are made known in WO 98/21014 or EP 0 206 981 A2, for example. In principle, such active damping elements are composed of an immersion coil 24 displaceably supported on a magnetic core, whereby the immersion coil is secured to the handle 2 and the magnetic core 23 is secured to the machine housing 1, or the immersion coil 24 is secured to the machine housing 1 and the magnetic core 23 is secured to the handle 2. The exact mode of operation of this active damping member will not be described in detail here, since a sufficient number of exemplary embodiments of this are made known in the related art. In principle, however, an active damping element functions in such a fashion that the relative motion of the handle 2 in relation to the machine housing 1, or the force exerted on the handle 2 is sensed, and the current flowing through the immersion coil 24 is controlled as a function of the measured relative motion or the force.

In deviation from the exemplary embodiments shown, more than just one spring element or more than just one active damping element can also be inserted between the handle 2 and the machine housing. The combination of spring element and active damping element is possible as well.

In the case of the exemplary embodiment shown in FIG. 5, the parallel rocker arm is formed by two leaf springs 25 and 26 that are bent in such a fashion that they press the handle 2 with its lower stop 17 with a preload against the fixed arm 19. In order to overcome this preload, a certain force must be exerted on the handle 2. When the preload of the leaf springs 25 and 26 is adjusted appropriately, it is possible—given a mean process force of, e.g., 100 N—to displace the handle 2 so far that the fixed arm 19 is located in the middle between the two stops 16 and 17. This can prevent a situation in which the arm 19 slams against the two stops 16 and 17 during a work operation. In the case of the exemplary embodiment shown in FIG. 5 as well, a damping element can also be inserted between the machine housing 1 and the shoulder 10 of the housing 2 extending in a horizontal direction, as shown in FIGS. 1, 2, and 4.

What is claimed is:

1. A hand power tool with vibration-damped handle that is coupled with a machine housing (1) wherein the handle (2) is coupled with the machine housing (1) via at least two identically extending leaf springs (25, 26) situated nearly perpendicular to a longitudinal axis (3) of the hand power tool, wherein the leaf springs (25, 26) are coupled with the machine housing (1) and the handle (2), wherein, the distances between two coupling points (6, 7, 8, 9) of the leaf springs are substantially equal, wherein the leaf springs are substantially equal, wherein the leaf springs are preloaded so as to press the handle (2) against the machine housing (1), and wherein coupling means is provided for movably coupling the handle with the machine housing and located between the leaf springs.

2. The hand power tool according to claim 1, wherein, with each lever (4, 5, 20, 21, 25, 26), a coupling point (6, 7) on the handle (2) is as far away as possible from a coupling point (8, 9) on the machine housing (1).

3. The hand power tool according to claim 1, wherein at least one lever (5) is placed in a shoulder of the handle (2), the handle extending approximately parallel to the longitudinal axis (3) of the hand power tool.

4. The hand power tool according to claim 1, wherein the leaf springs (25, 26) are preloaded against a force exerted on the handle (2) in the direction of the machine housing (1).

5. The hand power tool according to claim 1, wherein the relative motion of the handle (2) in relation to the machine housing (1) is limited by one or more stops (16, 17).

6. The hand power tool according to claim 1, wherein the lift springs (4, 5) are arranged parrallel to one another.

* * * * *